US006830483B1

(12) United States Patent
Wu

(10) Patent No.: US 6,830,483 B1
(45) Date of Patent: Dec. 14, 2004

(54) CABLE ASSEMBLY WITH POWER ADAPTER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/668,739

(22) Filed: Sep. 23, 2003

(51) Int. Cl.[7] ..... H01R 25/00
(52) U.S. Cl. ..... 439/638
(58) Field of Search ..... 439/638, 653, 439/488, 289, 498, 732, 675, 651, 76.1

(56) References Cited

U.S. PATENT DOCUMENTS

D412,700 S 8/1999 Gardner et al.
6,648,695 B1 * 11/2003 Wu ..... 439/638
6,761,592 B2 * 7/2004 Wu ..... 439/638
6,781,391 B2 * 8/2004 Reed et al. ..... 324/754
2002/0168902 A1 * 11/2002 Okamoto ..... 439/638

* cited by examiner

*Primary Examiner*—J. F. Duverne
(74) *Attorney, Agent, or Firm*—Wei Te Chung

(57) ABSTRACT

A cable assembly (100) includes a first connector (1) including a first insulating housing (10) and a number of first and second contacts (11, 12) received in the first housing, a cable (3) including a number of conductors (302, 304) electrically connecting with the first contacts, and a second connector including a second housing (20) back to back assembled to the first housing and a number of third contacts (22) electrically connecting with the second contacts of the first connector.

9 Claims, 15 Drawing Sheets

CABLE ASSEMBLY WITH POWER ADAPTER

CROSS-REFERENCE TO RELATED APPLICATIONS

This patent application is related to U.S. patent application Ser. No. 10/385,794 filed on Mar. 10, 2003 and entitled "ELECTRICAL ADAPTER", which is invented by the same inventor and assigned to the same assignee as this application.

BACKGROUND OF THE INVENTION

1. Field of the Invention

The present invention relates to a cable assembly, and particularly to a cable assembly having a cable connector and a power adapter respectively for signal and power transmission.

2. Description of Related Art

In recent days, an electrical connector known as a Serial Advanced Technology Attachment (Serial ATA) connector, according to the newly developed Serial ATA interface standard, is developed to be generally used for connecting storage peripheral devices such as hard disk drives with a mother printed circuit board so as to achieve signal or power transmission therebetween. The Serial ATA connector has many advantages such as low voltage requirement, low pin count and high speed transmission.

A pair of Serial ATA power cable assemblies are generally employed to perform power transmission between the storage peripheral device and the mother printed circuit board. Each Serial ATA power cable assembly comprises a cable with two Serial ATA power connectors terminating at two opposite ends thereof, one of which is connected to the mother printed circuit board or the storage peripheral device and another of which is adapted to mate with one of the connectors of another cable assembly. When the two matable Serial ATA power connectors mate with each other, a power transmission is thus established between the storage peripheral device and the mother printed circuit board. However, in some particular circumstances, the two matable Serial ATA power connectors of the pair of cable assemblies do not directly mate with each other. Accordingly, a power adapter is required for connecting these two matable Serial ATA power connectors together.

On the other hand, two separate connectors are generally provided to respectively perform the signal and power transmission between the storage peripheral device and the mother printed circuit board. However, forming the two separate connectors is expensive and inconvenient compared to the formation of a unitary member which can perform the functions of signal and power transmission.

Hence, a cable assembly having a cable connector and a power adapter respectively for signal and power transmission is highly desired.

SUMMARY OF THE INVENTION

Accordingly, an object of the present invention is to provide a cable assembly having a cable connector and a power adapter respectively for signal and power transmission.

In order to achieve the object set forth, a cable assembly in accordance with the present invention comprises a first connector, a cable and a second connector both electrically connecting to the first connector. The first connector comprises a first insulating housing having an elongated base with a first and a second mating ports integrally extending from one side thereof, and a plurality of first and second contacts received in the first and the second mating ports, respectively. The cable and the second connector are attached to the other side of the base along a lengthwise direction. The cable comprises a plurality of conductors electrically connecting with the first contacts. The second connector comprises a second housing back to back assembled to the first housing and a plurality of third contacts electrically connecting with the second contacts.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
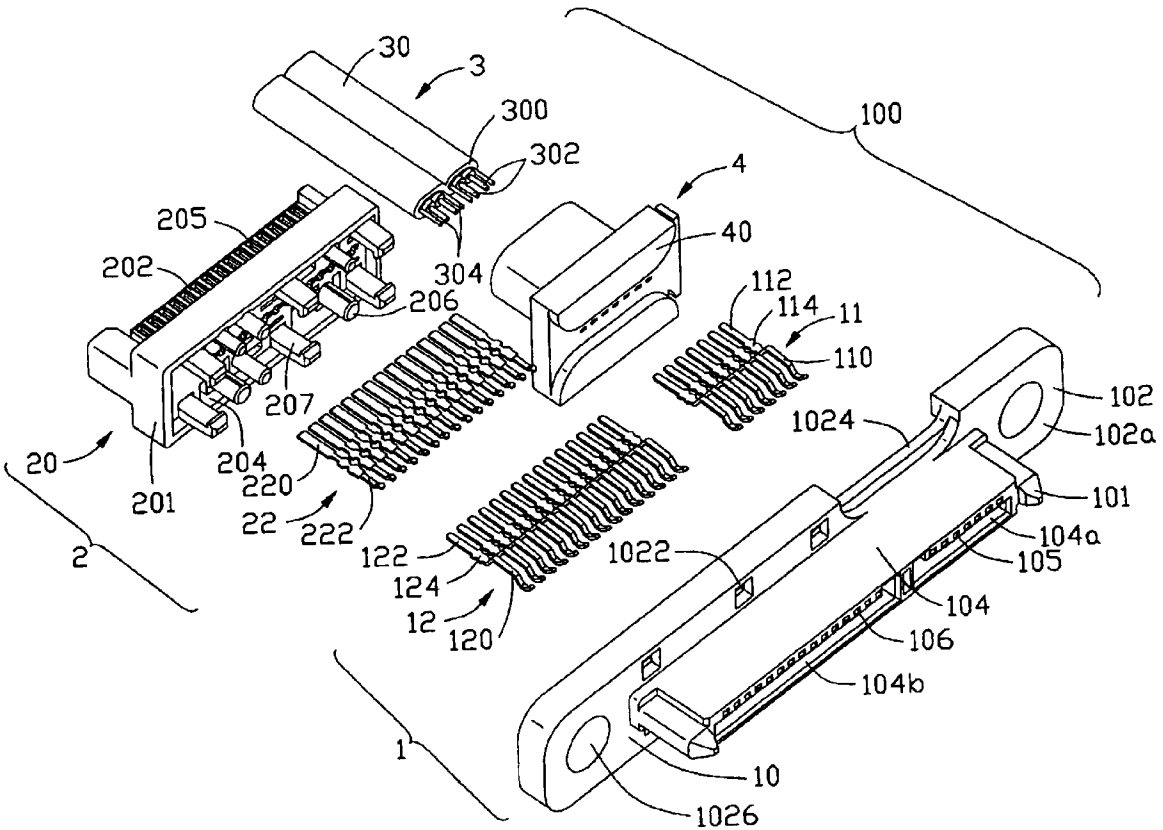
FIG. 1 is an exploded, perspective view of a cable assembly in accordance with the present invention.
Figure 2:
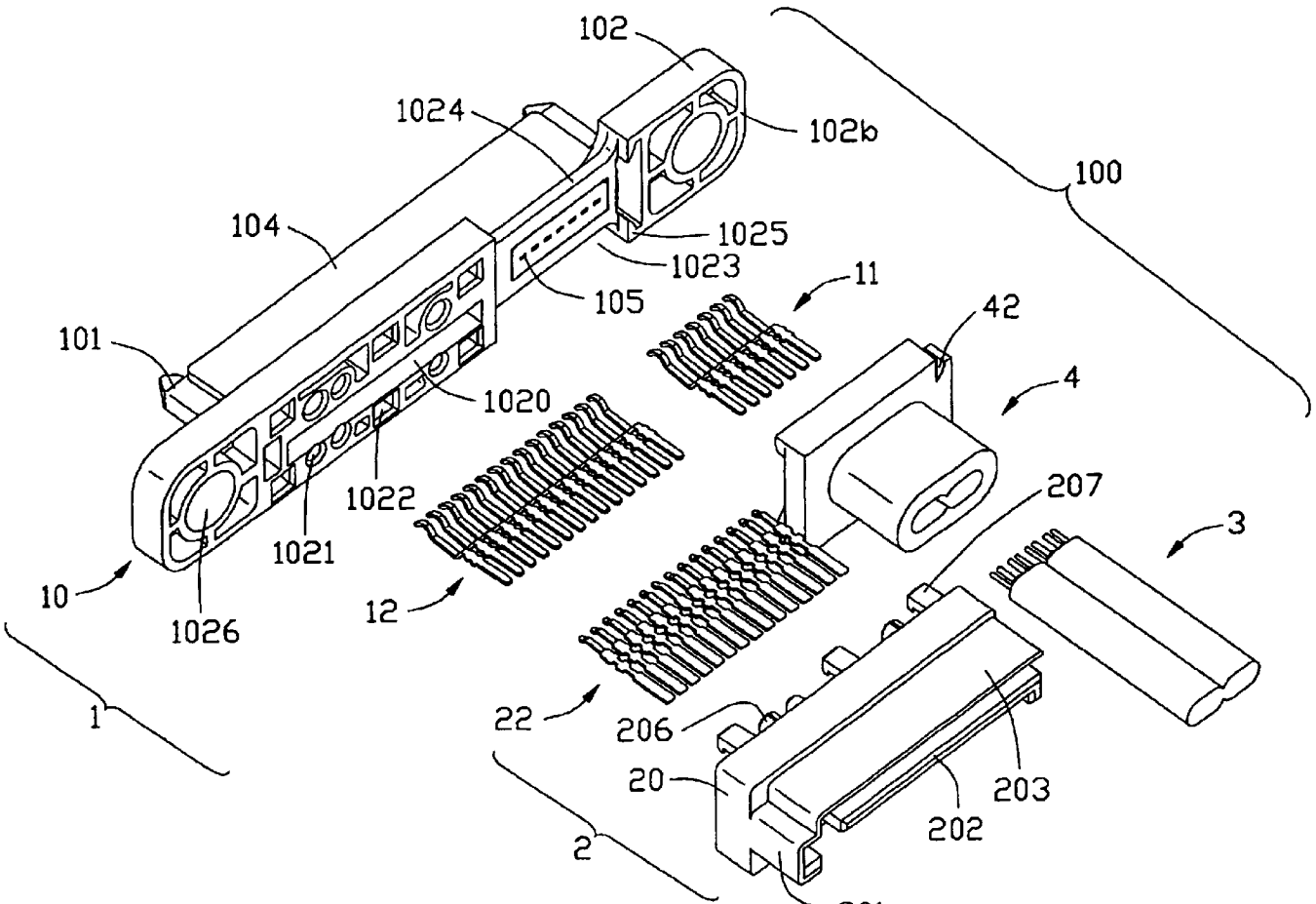
FIGS. 2 and 3 are views similar to FIG. 1, but taken from different aspects.
Figure 3:
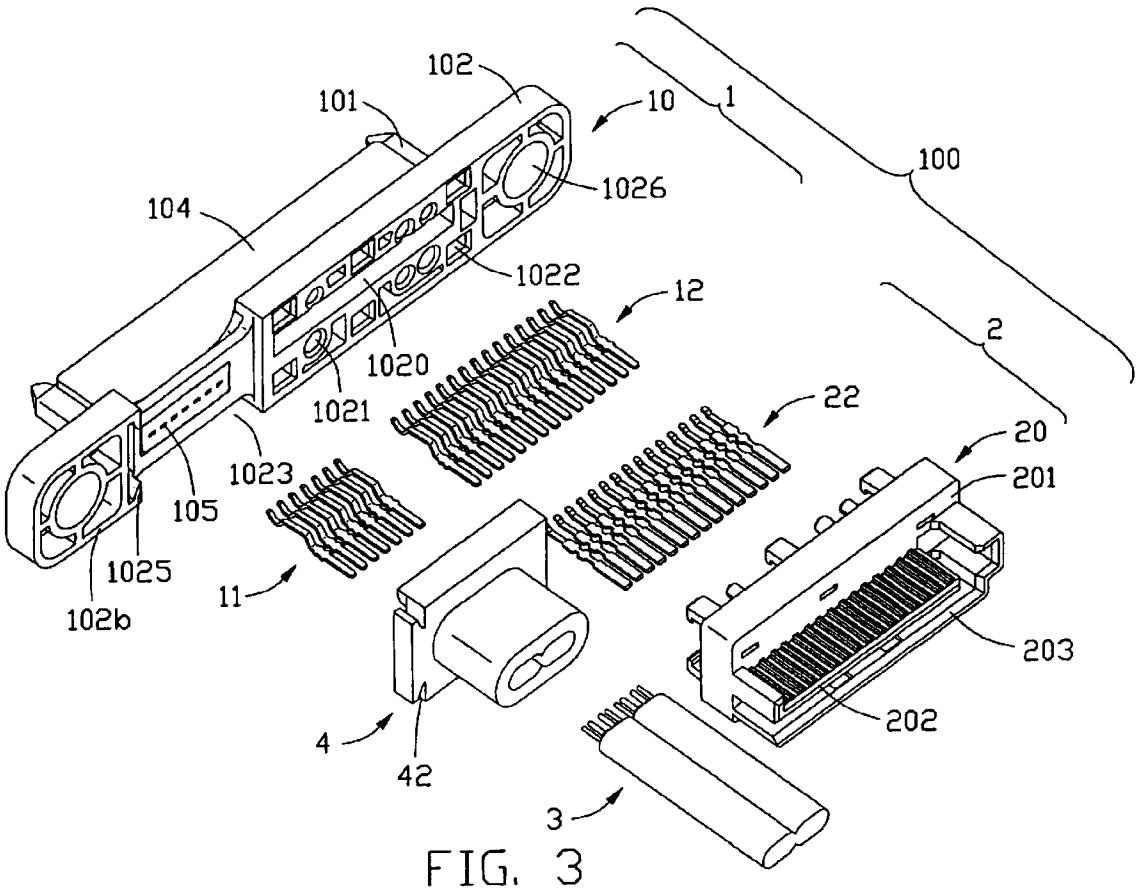

Referring to FIGS. 1, 2 and 3, a cable assembly 100 in accordance with the present invention comprises a first connector 1, a second connector 2 back to back assembled to the first connector 1, a cable 3 terminated to the first connector 1 and a cover 4 overmolded with the cable 3 and the first connector 1. In a preferred embodiment, the first connector 1 is a Serial Advanced Technology Attachment (Serial ATA) receptacle connector. The second connector 2 is a Serial ATA plug connector. The cable 3 is a Serial ATA cable.

The first connector 1 comprises a first insulating housing 10 and a plurality of first and second receptacle contacts 11, 12 retained in the first housing 10. The first housing 10 has an elongate base 102 and a mating section 104 extending perpendicularly and forwardly from a front face 102*a* of the base 102. A pair of guiding posts 101 is disposed at opposite ends of the mating section 104 for guiding the first connector 1 to mate with a first complementary connector (not shown).

Figure 12:
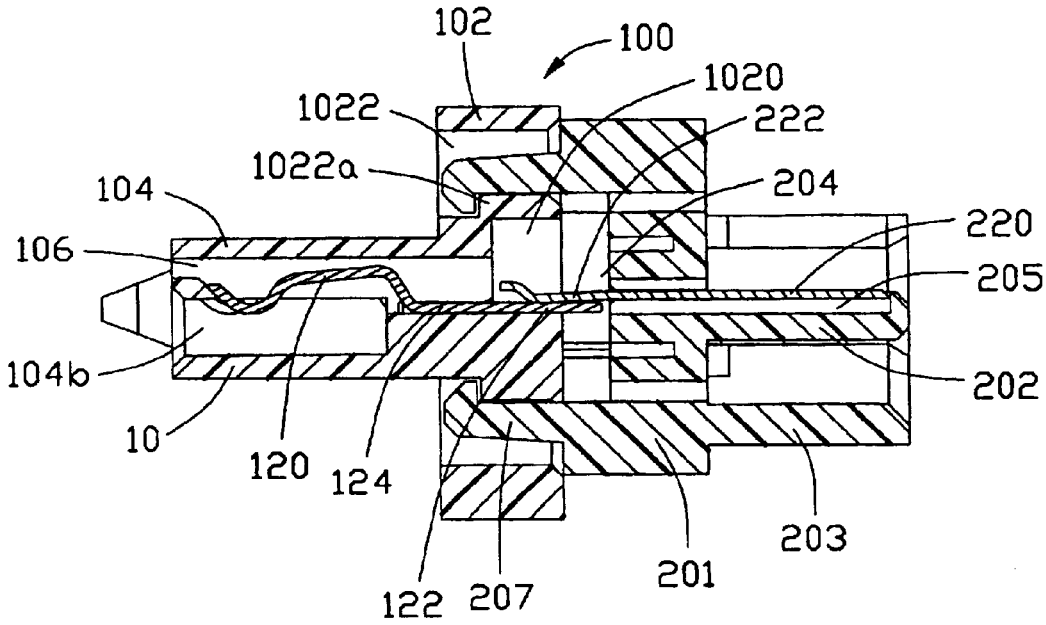
FIG. 12 is a cross-sectional view taken along line 12—12 of FIG. 10.
Figure 13:
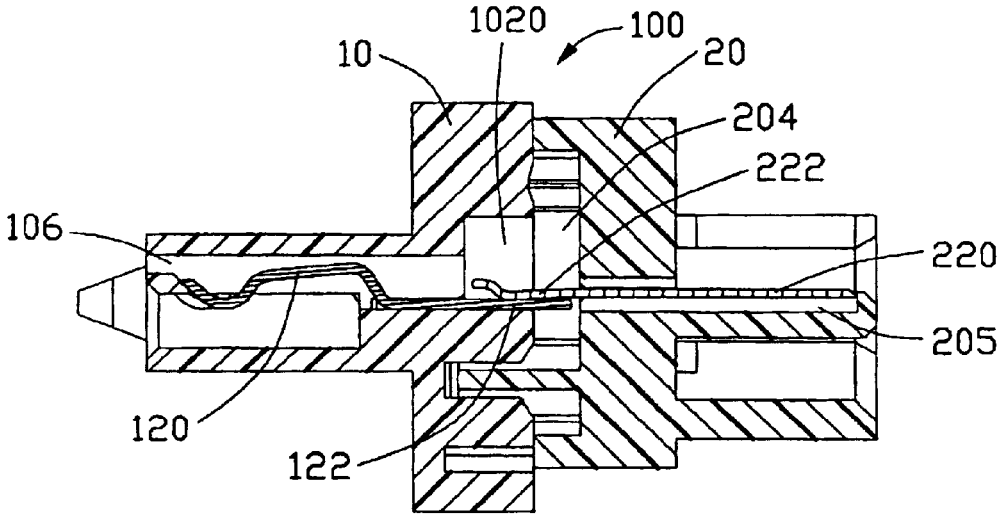
FIG. 13 is a cross-sectional view taken along line 13—13 of FIG. 10.

The mating section 104 includes a first and a second mating ports 104*a*, 104*b* arranged in a side-by-side manner wherein the first mating port 104*a* has a lengthwise dimension smaller than the second mating port 104*b*. The base 102 defines a cavity 1020 extending therethrough to communicate with the second mating port 104*b*, and a plurality of holes 1021 and slots 1022 located at upper and lower sides of the cavity 1020. The base 102 is formed with a projection 1022*a* (shown in FIG. 12) in each slot 1022. The base 102 defines a receiving space 1023 corresponding to the first mating port 104*a* in a rear face 102*b* thereof, and a pair of depressions 1024 communicating with the receiving space 1023 in top and bottom faces thereof. The base 102 is further formed with a pair of barbs 1025 in the receiving space 1023 and defines a pair of mounting holes 1026 adjacent opposite ends thereof. The first housing 10 defines a plurality of first passageways 105 communicating with the first mating port 104*a* and the receiving space 1023, and a plurality of second passageways 106 communicating with the second mating port 104*b* and the cavity 1020.

The first and the second receptacle contacts 11, 12 are assembled into the first and the second passageways 105, 106, respectively. The first receptacle contacts 11 has four signal contacts and three ground contacts and each include an engaging portion 110 received in the first mating port 104*a*, a tail portion 112 rearwardly extending out of the base 102 for connecting to the cable 3, and an intermediate portion 114 interconnecting the engaging portion 110 with the tail portion 112. The second receptacle contacts 12 are power contacts and each include a contact portion 120 received in the second mating port 104*b*, a connecting portion 122 extending rearwardly beyond an inner face of the cavity 1020, and a middle portion 124 interconnecting the contact portion 120 and the connecting portion 122.

Figure 7:
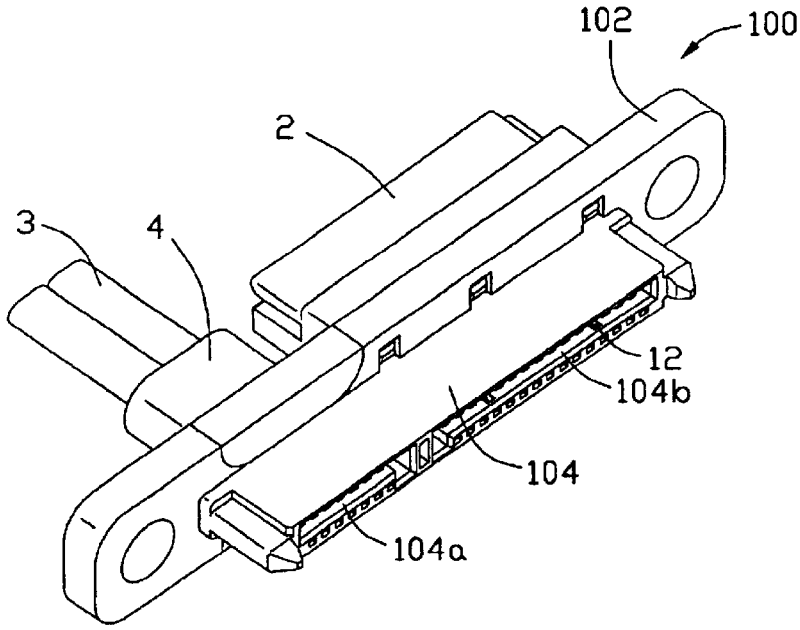
FIG. 7 is a view similar to FIG. 4 but taken from a different aspect.

Referring to FIG. 7, two receptacle power contacts 12 are positioned adjacent a mating face of the mating port 14 for first engaging with and last disengaging from the first complementary connector to achieve the function of hot plug.

The second connector 2 comprises a second insulating housing 20 and a plurality of plug power contacts 22 retained in the second housing 20. The second housing 20 includes an L-shaped body 201, a mating tongue 202 extending rearwardly from a middle portion of the body 201 for mating with a complementary second connector (not shown), and a plate 203 extending rearwardly from the body 201 and parallel to the mating tongue 202 for latching with the complementary second connector. The second housing 20 defines a recess 204 in a front face thereof and a plurality of channels 205 extending from the mating tongue 202 through the body 201 to communicate with the recess 204. The body 201 is formed with a plurality of rearwardly extending posts 206 and latches 207 for being received in the holes 1021 and the slots 1022 of the first housing 10, respectively.

The plug power contacts 22 are inserted into the channels 205 of the second housing 20 and each comprise a first mating portion 220 received in the mating tongue 202 for engaging with the second complementary connector, and a second mating portion 222 extending forwardly beyond an inner face of the recess 204 for contacting with the connecting portion 122 of a corresponding receptacle power contact 12.

The cable 3 comprises a pair of wires 30 each include an insulating jacket 300, a pair of differential signal conductors 302 and a pair of ground conductors 304 exposed out of the jacket 300 at one end thereof.

Figure 4:
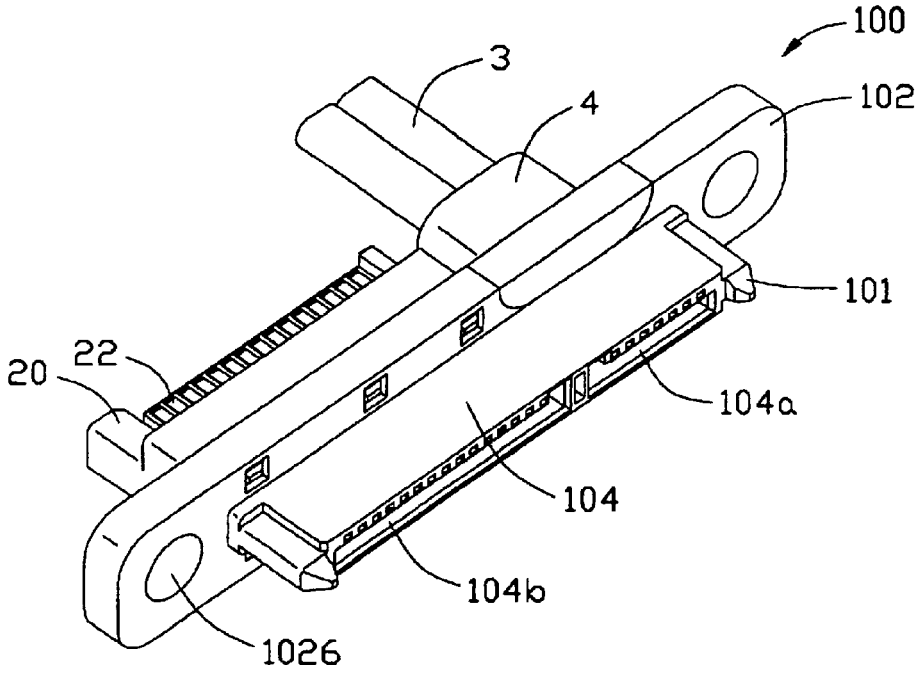
FIG. 4 is an assembled, perspective view of the cable assembly shown in FIG. 1.
Figure 5:
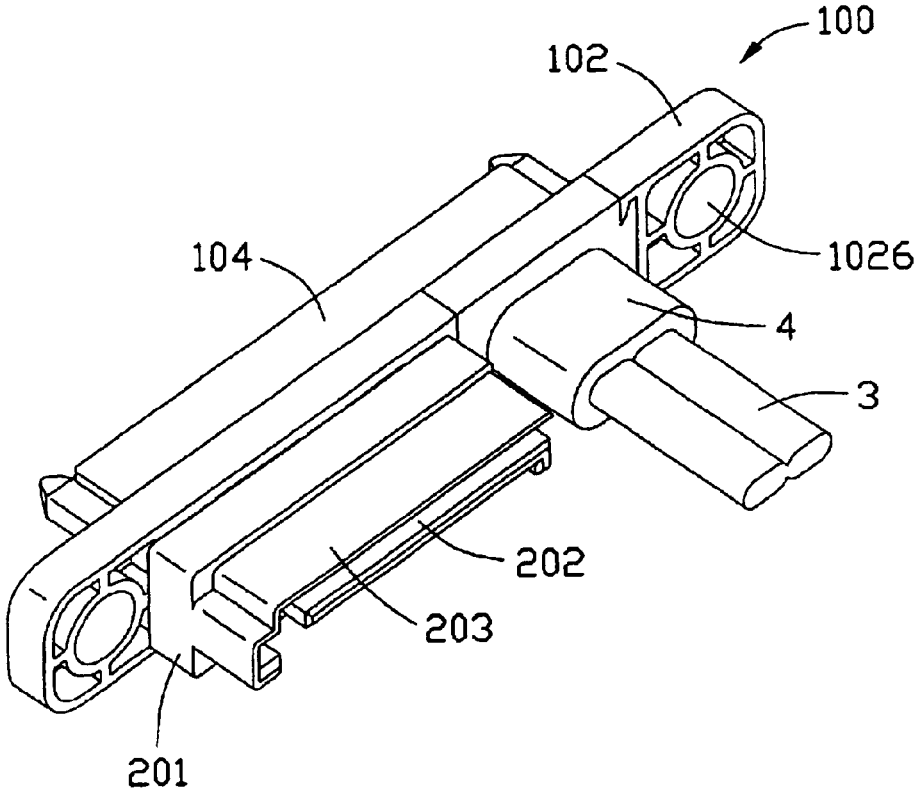
FIG. 5 is an assembled, perspective view of the cable assembly shown in FIG. 2.
Figure 6:
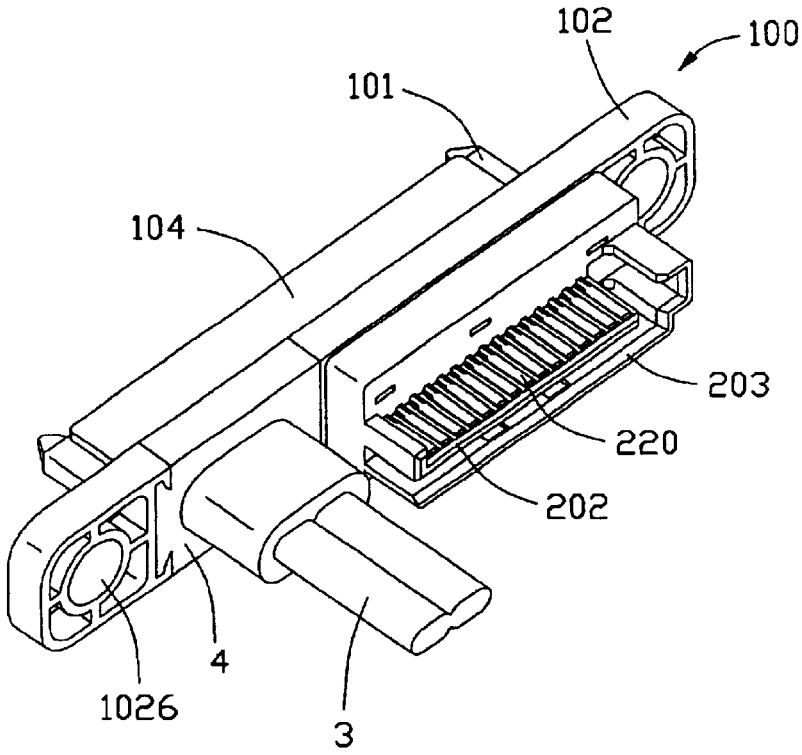
FIG. 6 is an assembled, perspective view of the cable assembly shown in FIG. 3.

Referring to FIGS. 4–6 in conjunction with FIGS. 1–3, four signal conductors 302 of the cable 3 are respectively soldered with the tail portions 112 of the four signal contacts of the first connector 1. One of the ground conductors 304 of each wire 30 is soldered with the tail portion 112 of a corresponding ground contact of the first connector 1, other two ground conductors 304 of the wires 30 are soldered to a common ground contact of the first connector 1.

The cover 4 is overmolded with the cable 3 and the first housing 10 after the wires 30 are soldered with the first contacts 11. The cover 4 has a pair of protrusions 40 received in the depressions 1024 of the first housing 10, and a pair of cutouts 42 receiving the barbs 1025 of the first housing 10.

Referring to FIGS. 10–13, the second connector 2 is back to back assembled to the first connector 1 with the posts 206 received in the holes 1021 of the first housing 10 and with the latches 207 latching with corresponding projections 1022*a* in the slots 1022 to thereby interlocking the first connector 1 with the second connector 2. The second mating portions 222 of the plug power contacts 22 extend into the cavity 1020 of the first housing 10 and resiliently contact with the connecting portions 122 of the receptacle power contacts 12, respectively. The connecting portions 122 of the receptacle power contacts 12 partially extend into the recess 204 of the second housing 20. The cable assembly 1 is thus formed.

It can be understood that the cable assembly 100 is formed by integrating a cable connector with a power adaptor, wherein the cable connector comprises the first contacts 11 received in the first mating port 104*a* of the first housing 10 and the cable 3 electrically connecting with the first contacts 11 for signal transmission, and wherein the power adaptor includes the second contacts 12 received in the second mating port 104*b* of the first housing 10 and the second connector 2 electrically connecting with the second contacts 12 for power transmission.

Figure 8:
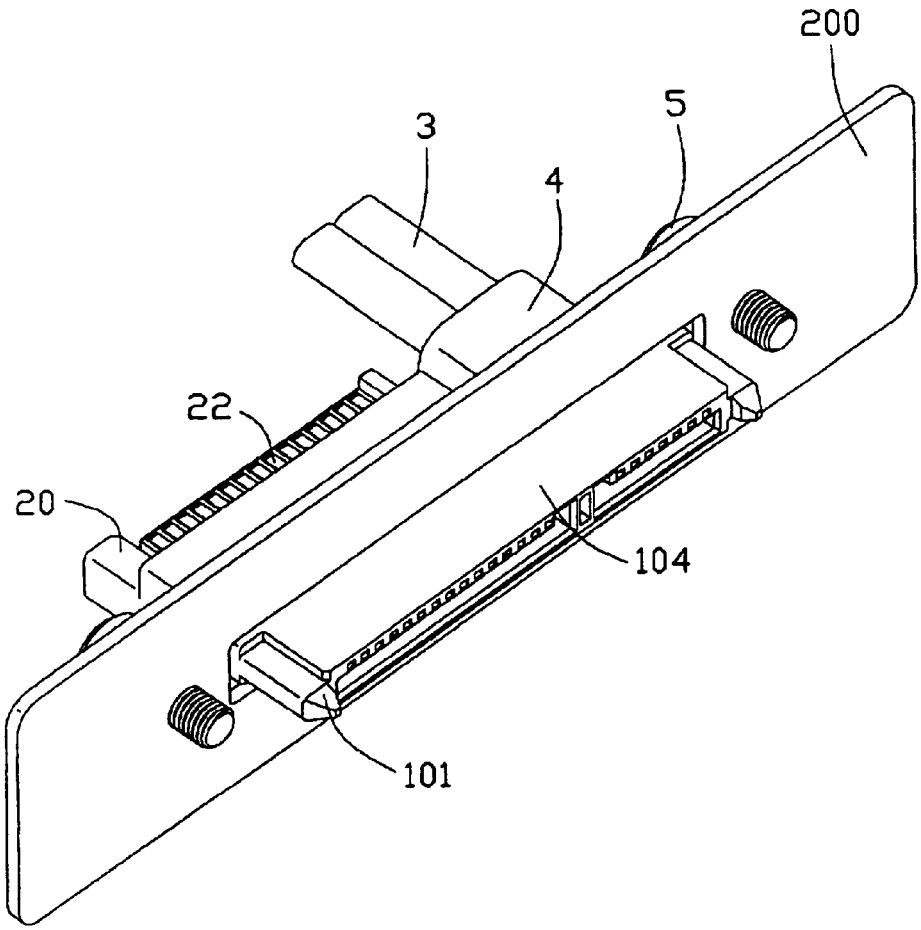
FIGS. 8 and 9 are different perspective views showing the cable assembly mounted on a panel.
Figure 9:
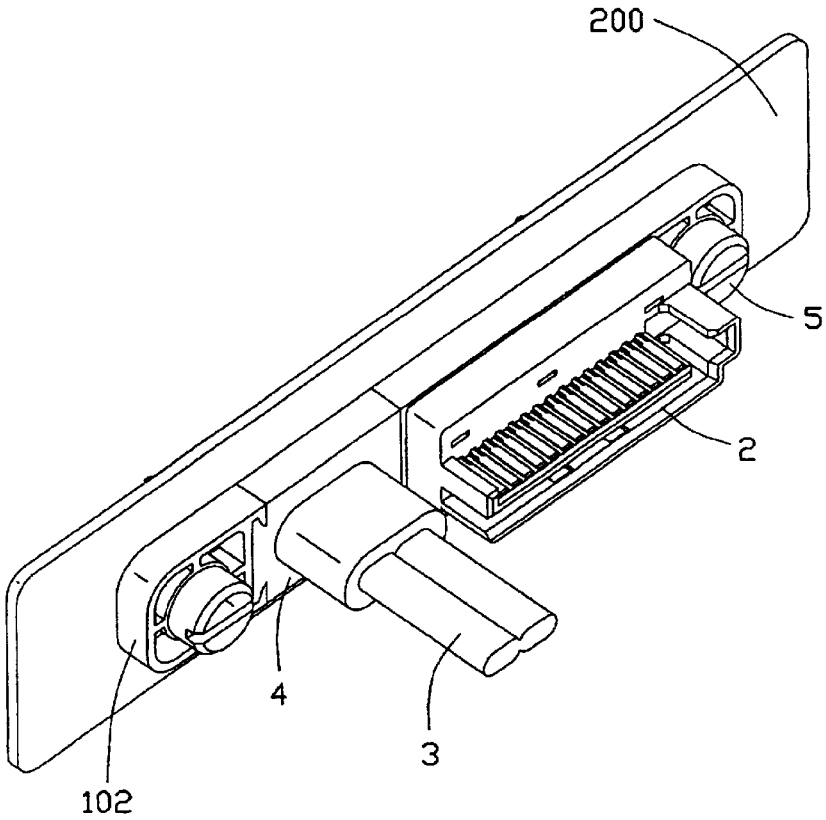
Figure 10:
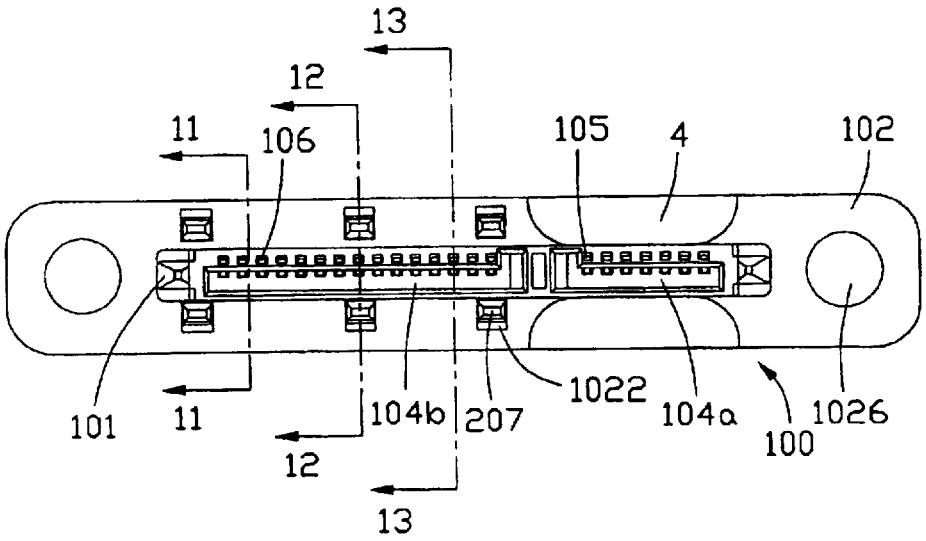
FIG. 10 is a front, plane view of the cable assembly of FIG. 4.
Figure 11:
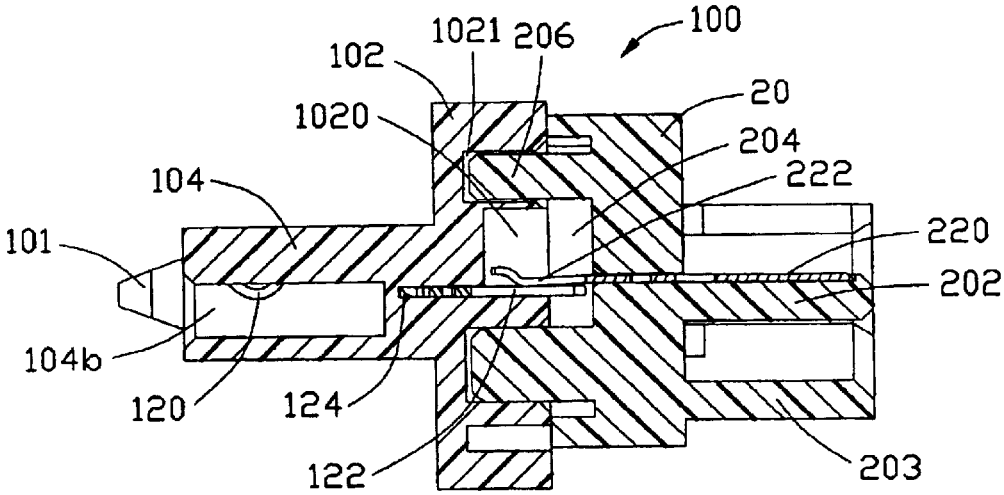
FIG. 11 is a cross-sectional view taken along line 11—11 of FIG. 10.

Referring to FIGS. 8 and 9, the cable assembly 100 is mounted on a panel 200 in a computer system (not shown) via a pair of bolts 5. The bolts 5 extend through the mounting holes 1026 of the first housing 10 and screw holes (not labeled) of the panel 200 to rivet with the panel 200.

Figure 14:
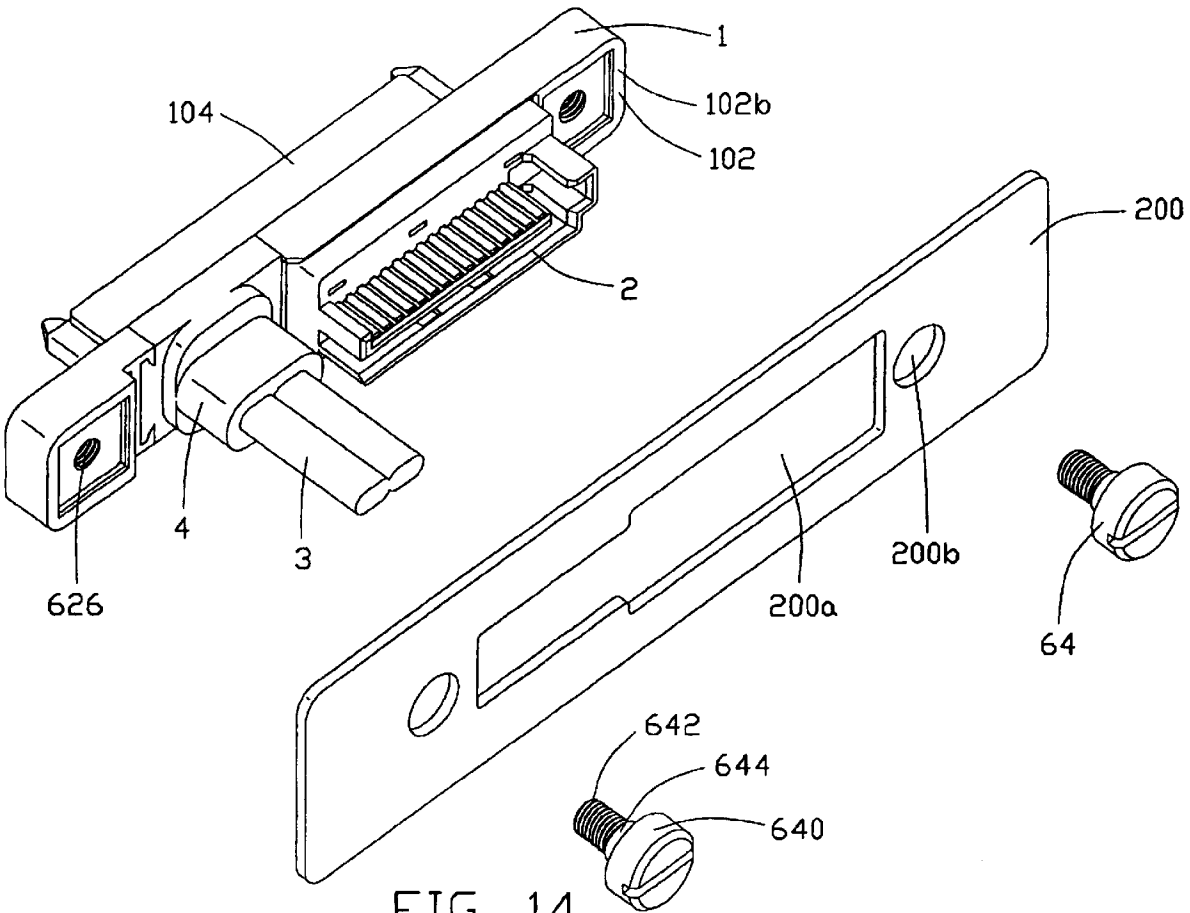
FIG. 14 is a perspective view showing the cable assembly, the panel and fastening means different from that shown in FIGS. 8 and 9 for mounting the cable assembly to the panel.
Figure 15:
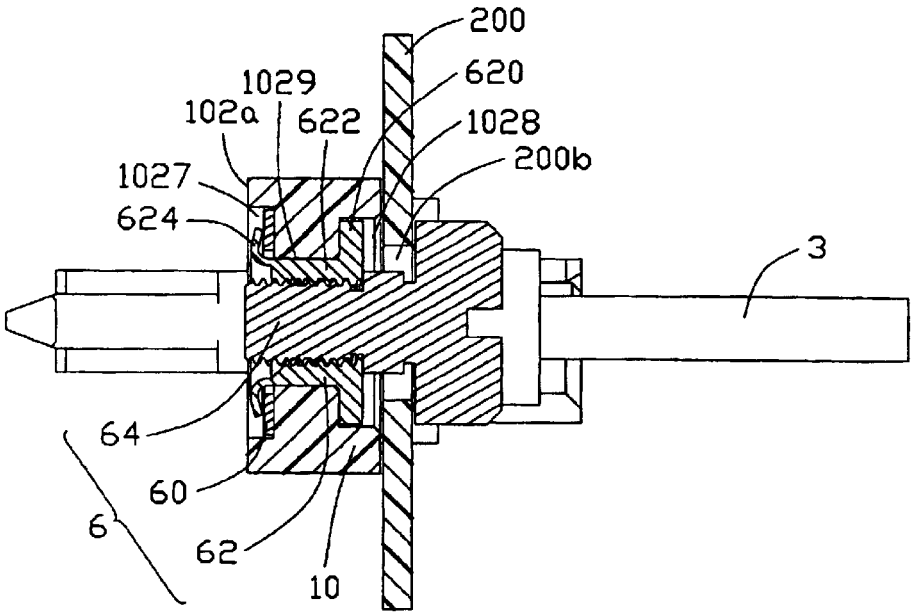
FIG. 15 is a cross-sectional view showing the cable assembly mounted on the panel via the fastening means shown in FIG. 14.

FIGS. 14 and 15 show the cable assembly 100 mounted on the panel 200 via fastening means different from that shown in FIGS. 8 and 9. The panel 200 defines a cutout 200*a* and a pair of through holes 200*b* at opposite sides of the cutout 200*a*. The mounting hole 1026 of the cable assembly 100 includes a front circular recess 1027 in the front face 102*a* of the base 102, a rear rectangular recess 1028 in the rear face 102*b* of the base 102, and a rounded hole 1029 located between the front circular recess 1027 and the rear rectangular recess 1028. A pair of fastening devices 6 is provided to associate with the mounting hole 1026 and the through hole 200*b* for mounting the cable assembly 100 on the panel 200.

Each fastening device 6 comprises a washer 60, a hardware rivet 62 and a bolt 64. The washer 60 is assembled into the front circular recess 1027 from the front face 102*a* of the base 102. The hardware rivet 62 is assembled into the mounting hole 1026 from the rear face 102*b* of the base 102 and includes a rectangular plate 620 received in the rear recess 1028, a cylindrical post 622 extending from the plate 620 and received in the rounded hole 1029, and an annular end 624 located at a front end of the cylindrical post 622 and extending into the front recess 1027 through a through hole (not labeled) of the washer 60. The rectangular plate 620 forwardly abuts against an inner face of the rear recess 1028 and the annular end 624 rearwardly abuts against the washer 60 to thereby retaining the washer 60 and the hardware rivet 62 in the base 102. The bolt 64 includes an enlarged head 640, a screw post 642 and a middle portion 644 connecting the head 640 and the screw post 642. After the second connector 2 and the cable 3 extend through the cutout 202 of the panel 200, the bolt 64 extends into a screw hole 626 through the through hole 200*b* of the panel 200 with the screw post 642 engaging with the screw hole 626 and with the middle portion 644 and the enlarged head 640 respectively abutting against the plate 620 and the panel 200. Thus, the cable assembly 100 is mounted on the panel 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A cable assembly comprising: a first connector comprising a first insulating housing and a plurality of first and second contacts retained to the first housing, each of the first and the second contacts comprising an engaging portion received in the first housing and an opposite connecting portion; a cable comprising a plurality of conductors connecting portions of the first contacts; and electrically connecting with the a second connector comprising a second housing back to back assembled to the first insulating housing and a plurality of third contacts electrically connecting with the connecting portions of the second contacts, wherein the first housing defines a first and a second mating ports respectively receiving the first and the second contacts; wherein the first housing includes, along a lengthwise direction thereof, an elongated base with the first and the second mating ports integrally extending from one side thereof, and with the cable and the second connector attached to the other side thereof, alone the lengthwise direction; wherein the base defines a cavity communicating with the second mating sort, and the second housing defines a recess aligned with and communicating with the cavity the second and the third contacts partially extending into the recess and the cavity, respectively; wherein the base defines a plurality of holes and slots at upper and lower sides of the cavity, and the second housing is formed with a plurality of posts and latches received in the holes and the slots, respectively; the cable assembly further comprising a cover overmolded with the cable and the base.

2. The cable assembly as claimed in claim 1, wherein the first contacts include signal and ground contacts, and the second and the third contacts are power contacts.

3. The cable assembly as claimed in claim 2, wherein the conductors of the cable include signal and ground conductors respectively connecting with the signal and the ground contacts.

4. The cable assembly as claimed in claim 3, wherein one of the ground contacts electrically connect with a pair of ground conductors.

5. The cable assembly as claimed in claim 1, wherein the second contacts electrically connect with the third contacts in a one on one relationship.

6. The cable assembly as claimed in claim 5, wherein each third contact comprises a mating portion resiliently abutting against the connecting portion of a corresponding second contact.

7. The cable assembly as claimed in claim 1, wherein the second connector is configured with a Serial Advance Technology Attachment (Serial ATA) interface and includes a body, a mating tongue extending from a middle portion of the body for mating with a complementary connector, and a plate extending from the body and parallel to the mating tongue for latching with the complementary connector.

8. An electrical connector assembly comprising:

a first connector including a first insulative housing extending along a longitudinal direction, said first housing defining juxtaposed first and second mating ports on a front face;

a plurality of first contacts disposed in the first housing, said first contacts being divided into first and second groups corresponding to said first and second mating ports, each of said first contacts defining a front engaging portion disposed in the corresponding mating port;

a cable permanently associated with the first housing and extending in a front-to-back direction perpendicular to said longitudinal direction, and including a plurality of conductors electrically and mechanically connected to the first contacts of the first group; and a second connector including a second insulative housing extending along said longitudinal direction while being discrete from and shorter than the first housing in said longitudinal direction, said second housing attached to a rear face of the first housing, and defining a third mating port exposed to an exterior rearwardly relative to the first housing; wherein said third mating port is essentially aligned with the second mating port in the front-to-back direction for allowing a complementary connector, which is mateable with the third mating port, to be electrically connected to said first contacts of said second group.

9. The connector assembly as claimed in claim 8, wherein the second connector includes a plurality of second contacts mechanically and electrically engaged with the corresponding first contacts, respectively, for electrically connecting the complementary connector to the first contacts of said second group.

* * * * *